US007302809B2

(12) United States Patent
Park

(10) Patent No.: US 7,302,809 B2
(45) Date of Patent: Dec. 4, 2007

(54) REFRIGERATOR

(75) Inventor: Yong Pil Park, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 315 days.

(21) Appl. No.: 11/204,093

(22) Filed: Aug. 16, 2005

(65) Prior Publication Data

US 2006/0065006 A1 Mar. 30, 2006

(30) Foreign Application Priority Data

Sep. 30, 2004 (KR) ..... 10-2004-0078100

(51) Int. Cl.
*F25C 5/18* (2006.01)

(52) U.S. Cl. ..... 62/344; 222/146.6; 251/251

(58) Field of Classification Search ..... 62/344, 62/347–353; 222/146.6, 548, 555–556, 559, 222/561; 251/129.11, 251, 263
See application file for complete search history.

(56) References Cited

U.S. PATENT DOCUMENTS 4,487,024 A * 12/1984 Fletcher et al. ..... 62/3.63
5,442,933 A * 8/1995 Unger ..... 62/275

FOREIGN PATENT DOCUMENTS

KR 10-285847 1/2001
KR 2001-26389 4/2001

OTHER PUBLICATIONS

Chinese Office Action for corresponding application No. 200510096551.3.

* cited by examiner

*Primary Examiner*—William E. Tapolcai
(74) *Attorney, Agent, or Firm*—Staas & Halsey LLP

(57) ABSTRACT

A refrigerator having a shaved ice discharger to discharge shaved ice produced within the refrigerator to an outside of the refrigerator. The refrigerator includes a body having a freezing compartment defined therein, a freezing compartment door to open and close the freezing compartment, a shaved-ice maker positioned in the freezing compartment to produce shaved ice, a shaved ice discharge port to discharge the shaved ice produced by the shaved-ice maker to the outside of the refrigerator, and a shaved ice discharger to open the shaved ice discharge port for a predetermined time. The shaved ice discharger maintains an open state of the shaved ice discharge port for the predetermined time therefore, it is not necessary to continuously apply external force to the lever, and convenience in use of the shaved-ice maker is improved.

11 Claims, 5 Drawing Sheets

REFRIGERATOR

CROSS-REFERENCE TO RELATED APPLICATIONS

This application claims the benefit of Korean Patent Application No. 2004-78100, filed on Sep. 30, 2004 in the Korean Intellectual Property Office, the disclosure of which is incorporated herein by reference.

BACKGROUND OF THE INVENTION

1. Field of the Invention

The present invention relates to a refrigerator, and, more particularly, to a refrigerator, which has a shaved ice discharger to discharge shaved ice produced in the refrigerator to the outside.

2. Description of the Related Art

Generally, a refrigerator generates cold air through a cooling cycle within the refrigerator, so that various foods can be stored in a refrigerated state or a frozen state by means of the cold air therein. In particular, a large refrigerator is equipped with an automatic icemaker to automatically produce ice cubes.

Recently, in order to prepare shaved ice or iced beverages using shaved ice, a refrigerator has been developed which includes a shaved-ice maker to produce the shaved ice by pulverizing the ice cubes supplied from the automatic icemaker, and a shaved ice discharger to discharge the shaved ice produced in the shaved-ice maker to an outside of the refrigerator, so that the shaved ice produced in the refrigerator by the shaved-ice maker can be supplied to the outside thereof.

The shaved ice discharger includes a damper to open/close a shaved ice discharge port provided in a freezing compartment door, and a discharge lever hinged to the freezing compartment door such that the discharge lever is rotated when external force is applied thereto, and operates the damper to open the shaved ice discharge port.

However, since such a conventional refrigerator requires a considerable time for producing the shaved ice by pulverizing the shaved ice through the shaved-ice maker, there is an inconvenience in that a user of the refrigerator must continuously press the discharge lever for an extended period of time.

SUMMARY OF THE INVENTION

Accordingly, it is an aspect of the present invention to provide a refrigerator, which can keep a shaved ice discharge port open for a predetermined time.

Additional aspects and/or advantages of the invention will be set forth in part in the description which follows and, in part, will be apparent from the description, or may be learned by practice of the invention.

These and/or other aspects of the present invention are achieved by providing a refrigerator including a body having a freezing compartment defined therein, a freezing compartment door to open and close the freezing compartment, an ice tray to freeze water therein, thus forming ice cubes, an ice cube container disposed below the ice tray to contain the ice cubes, a shaved-ice maker positioned in the freezing compartment, to produce shaved ice using the ice cubes supplied from the ice cube container, a shaved ice discharge port to discharge the shaved ice produced by the shaved-ice maker to an outside of the refrigerator through the freezing compartment door, and a shaved ice discharger to open the shaved ice discharge port for a predetermined time, wherein, the shaved ice discharger includes a damper hinged to one side of the shaved ice discharge port to open and close the shaved ice discharge port while hinging, and an opening/closing cam to transmit a rotational force to the damper according to a rotational angle of the opening/closing cam, thereby operating the damper to open the shaved ice discharge port.

The opening/closing cam rotates by a driving motor which generates the rotational force, wherein the driving motor includes a step motor to maintain the rotational angle of the opening/closing cam for the predetermined time.

The damper includes a first cam contact portion at one side thereof, to contact the opening/closing cam, and to receive the rotational force transmitted from the opening/closing cam. The opening/closing cam includes a first cam protruded thereon, to contact and press the first cam contact portion while rotating.

The freezing compartment door includes a switch to apply electric power to the driving motor of the refrigerator when depressed, and a discharge lever hinged to a lower end of the shaved ice discharge port and hingably moved by application of an external force applied thereto, to depress the switch.

The discharge lever includes a second cam contact portion to allow the discharge lever to receive the rotational force from the opening/closing cam, thereby causing a lower end of the discharge lever to be pressed backward, and a second cam to contact and press the second cam contact portion while rotating.

It is another aspect of the present invention to provide a refrigerator including a body having a freezing compartment defined therein, a freezing compartment door to open/close the freezing compartment, a shaved-ice maker positioned in the freezing compartment to produce shaved ice, a shaved ice discharge port to discharge the shaved ice produced by the shaved-ice maker to an outside of the refrigerator through the freezing compartment door, a damper hinged to one side of the shaved ice discharge port to open/close the shaved ice discharge port, a discharge lever hinged to a lower end of the shaved ice discharge port such that a lower end of the discharge lever is pressed backward to operate the damper to open the shaved ice discharge port, and an opening/closing cam to operate the damper to open the shaved ice discharge port while allowing the discharge lever to be pressed backward.

The opening/closing cam includes a first cam to transmit a rotational force to the damper while rotating to open the shaved ice discharge port, and a second cam to transmit the rotational force to the discharge lever and to the discharge lever backward, thereby causing the lower end of the discharge lever to be pressed backward.

The opening/closing cam rotates by a driving motor which generates the rotational force, wherein the driving motor includes a step motor to maintain a rotational angle of the opening/closing cam for a predetermined time.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE PREFERRED EMBODIMENTS

Figure 1:
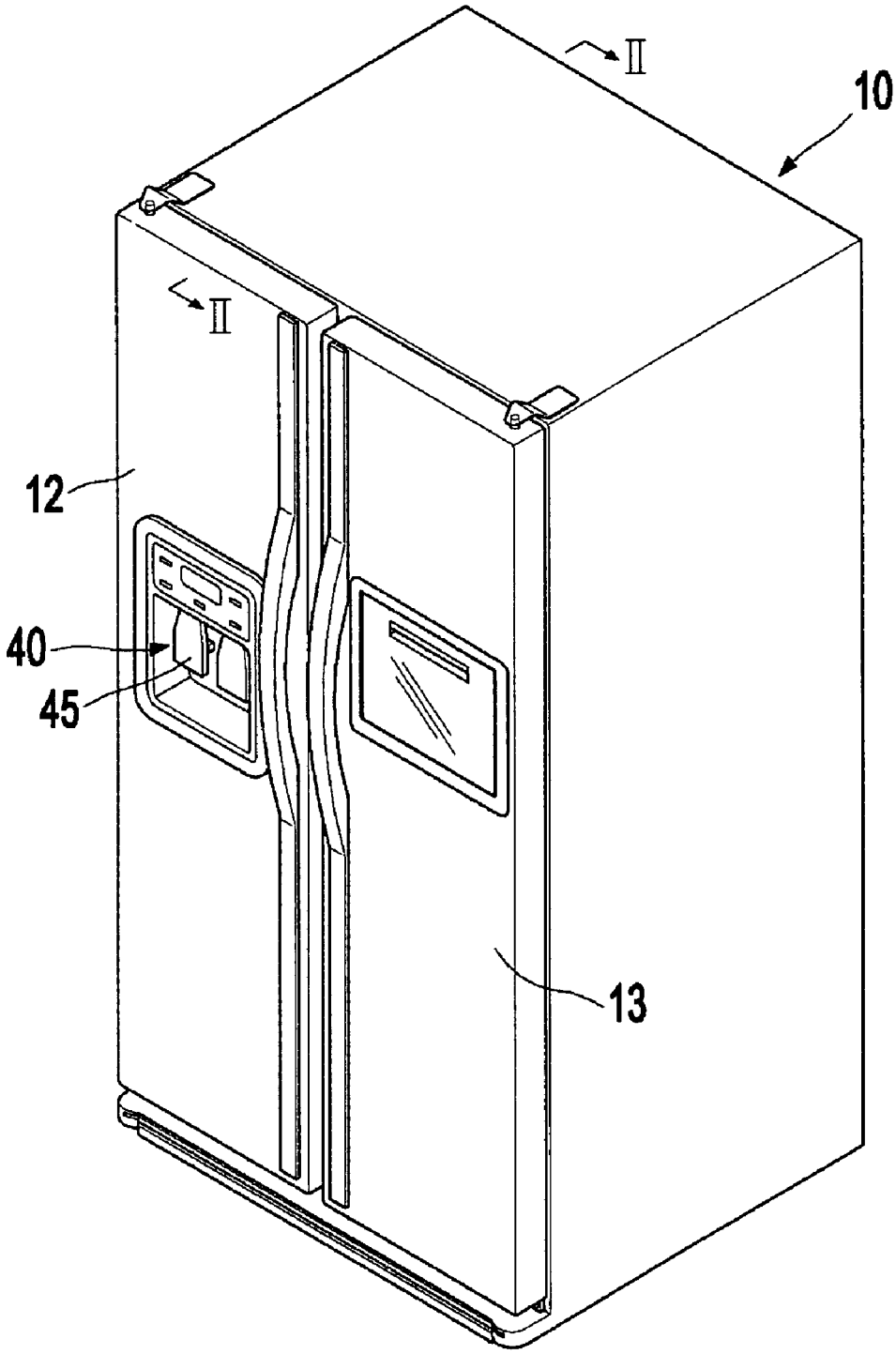
FIG. 1 is a perspective view illustrating a refrigerator in accordance with the present invention.

Reference will now be made in detail to the embodiments of the present invention, examples of which are illustrated in the accompanying drawings, wherein like reference numerals refer to the like elements throughout. The embodiments are described below to explain the present invention by referring to the figures.

Figure 2:
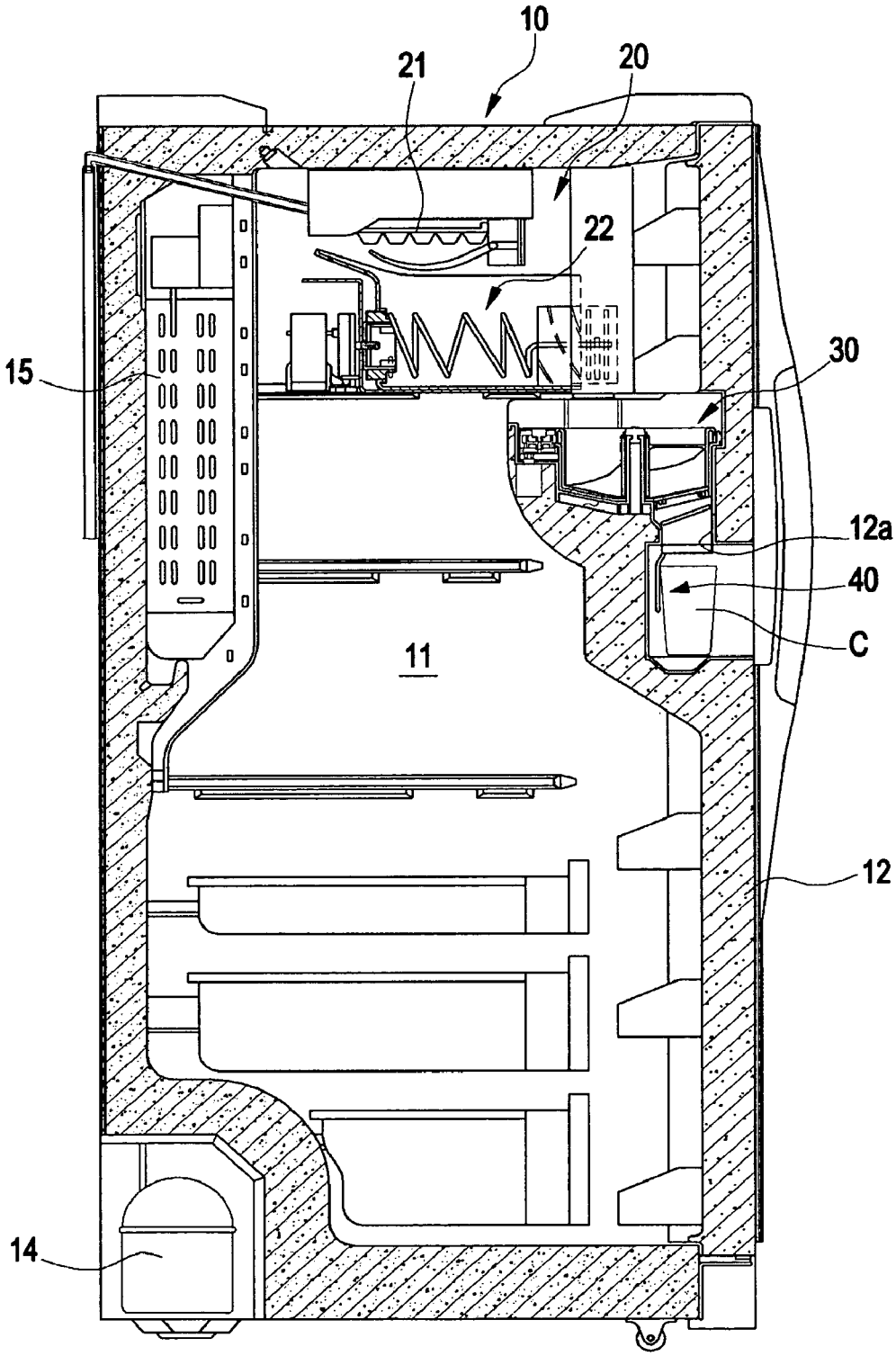
FIG. 2 is a cross-sectional view illustrating the refrigerator of FIG. 1.

In FIGS. 1 and 2, a refrigerator in accordance with the present invention comprises a body 10 opened at the front side thereof and having an inner portion partitioned into a freezing compartment 11 and a refrigerating compartment (not shown). The freezing compartment 11 and the refrigerating compartment are opened and closed by a freezing compartment door 12 and a refrigerating compartment door 13 hinged to the front side of the body, respectively.

The refrigerator comprises a compressor 14 at a rear lower portion of the body 10 to compress a refrigerant, an evaporator 15 on a rear wall of the body 10 to generate cold air, and an automatic icemaker 20 within the freezing compartment 11 to automatically produce and supply ice cubes having a predetermined size after receiving the cold air produced from the evaporator 15.

The automatic icemaker 20 comprises an ice tray 21, to freeze water therein, thus forming ice cubes, an ice cube container 22 disposed below the ice tray 21 to contain the ice cubes formed in the ice tray 11, and an ice cube conveyer 23 disposed in the ice container 22 to convey the ice cubes to the freezing compartment door 12.

The freezing compartment door 12 is provided with a shaved-ice maker 30 to produce shaved ice using the ice cubes supplied from the ice cube container 22, and a shaved ice discharge port 12*a* to allow the shaved ice produced by the shaved-ice maker 30 to be discharged to the outside through the freezing compartment door 12. The shaved ice discharge port 12*a* comprises a shaved ice discharger 40 to discharge the shaved ice produced by the shaved-ice maker 30 to the outside.

Figure 3:
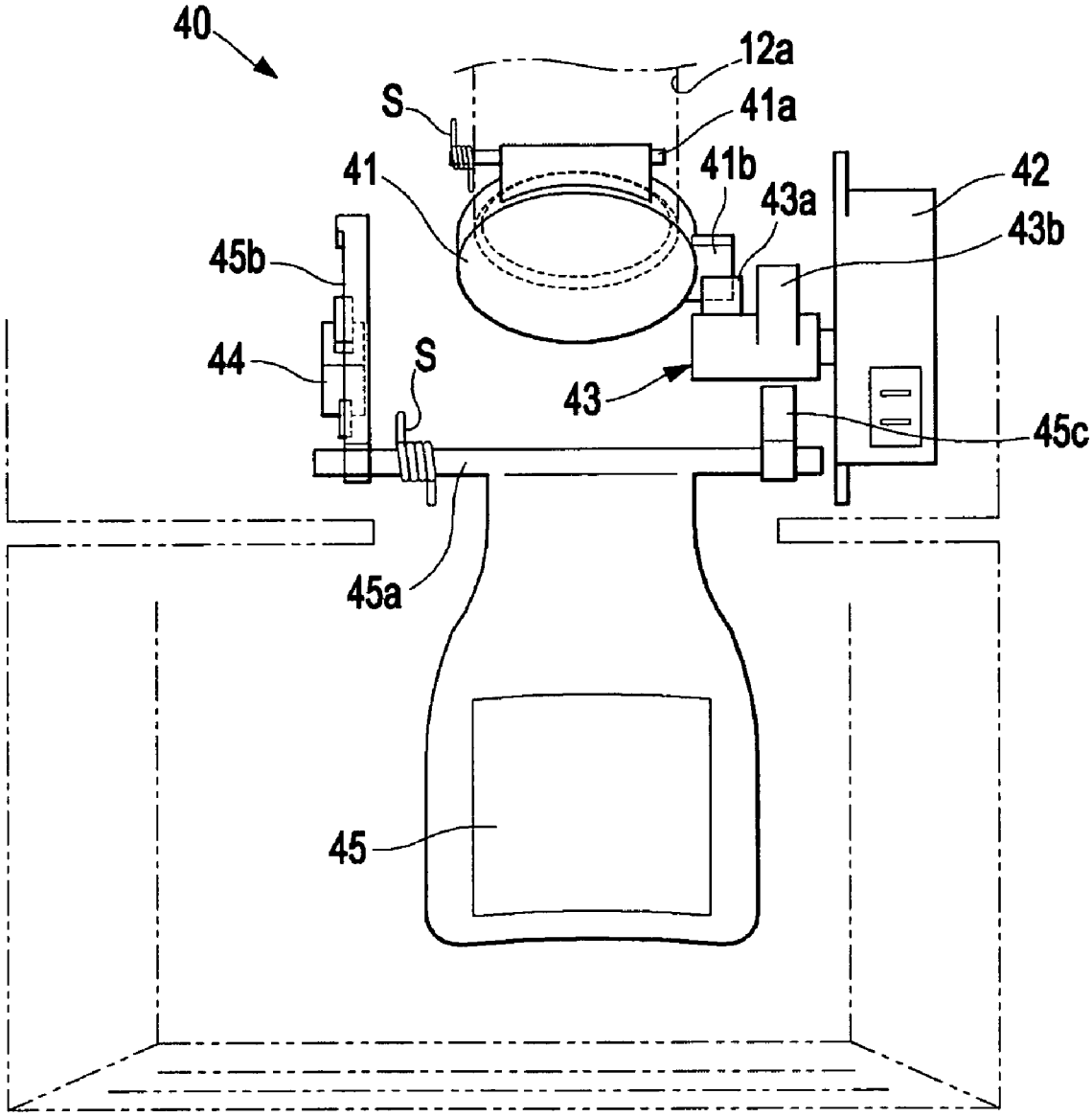
FIG. 3 is a front view illustrating a shaved ice discharger of the refrigerator of FIG. 1.
Figure 4:
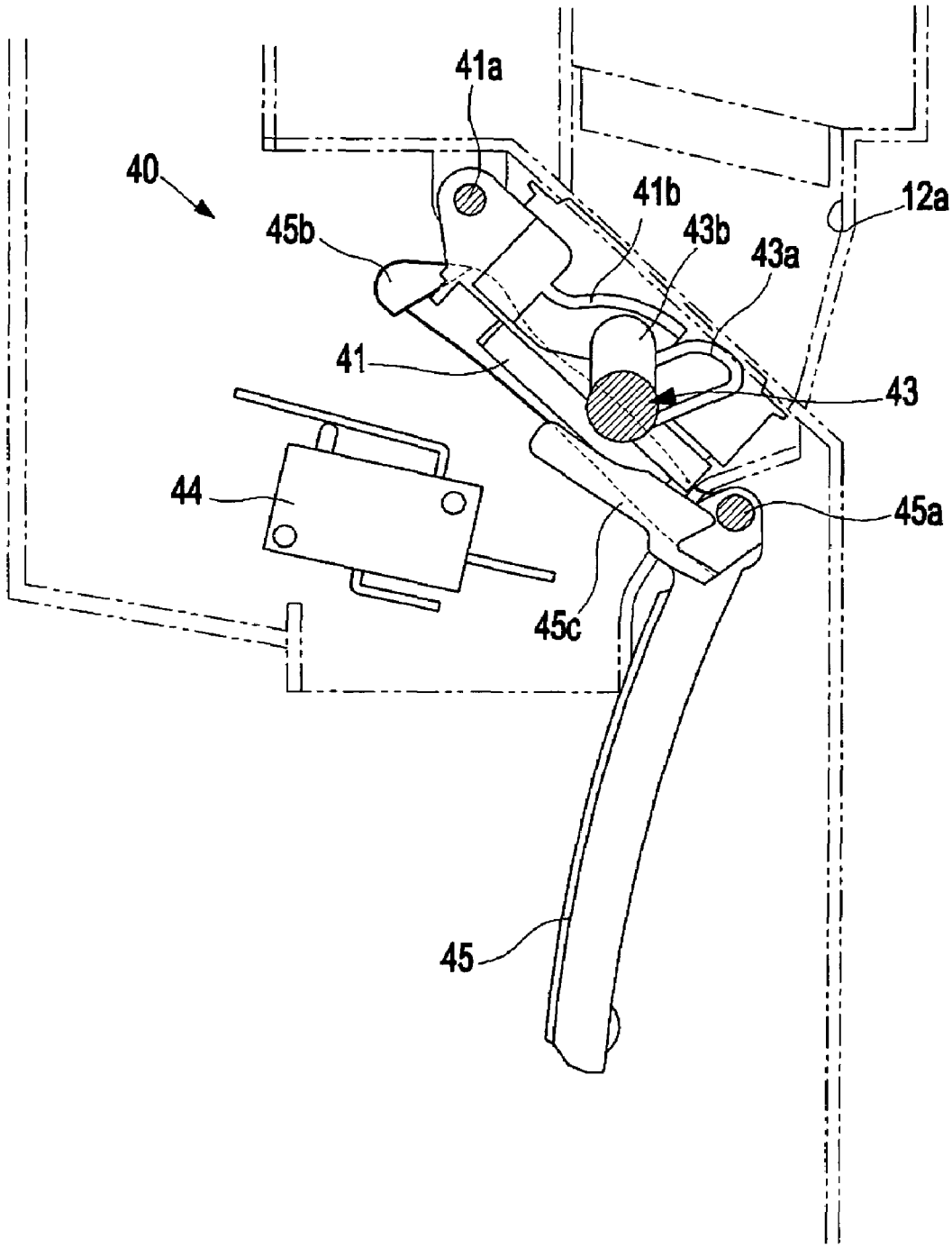
FIG. 4 is a side view illustrating the shaved ice discharger of FIG. 3.
Figure 5:
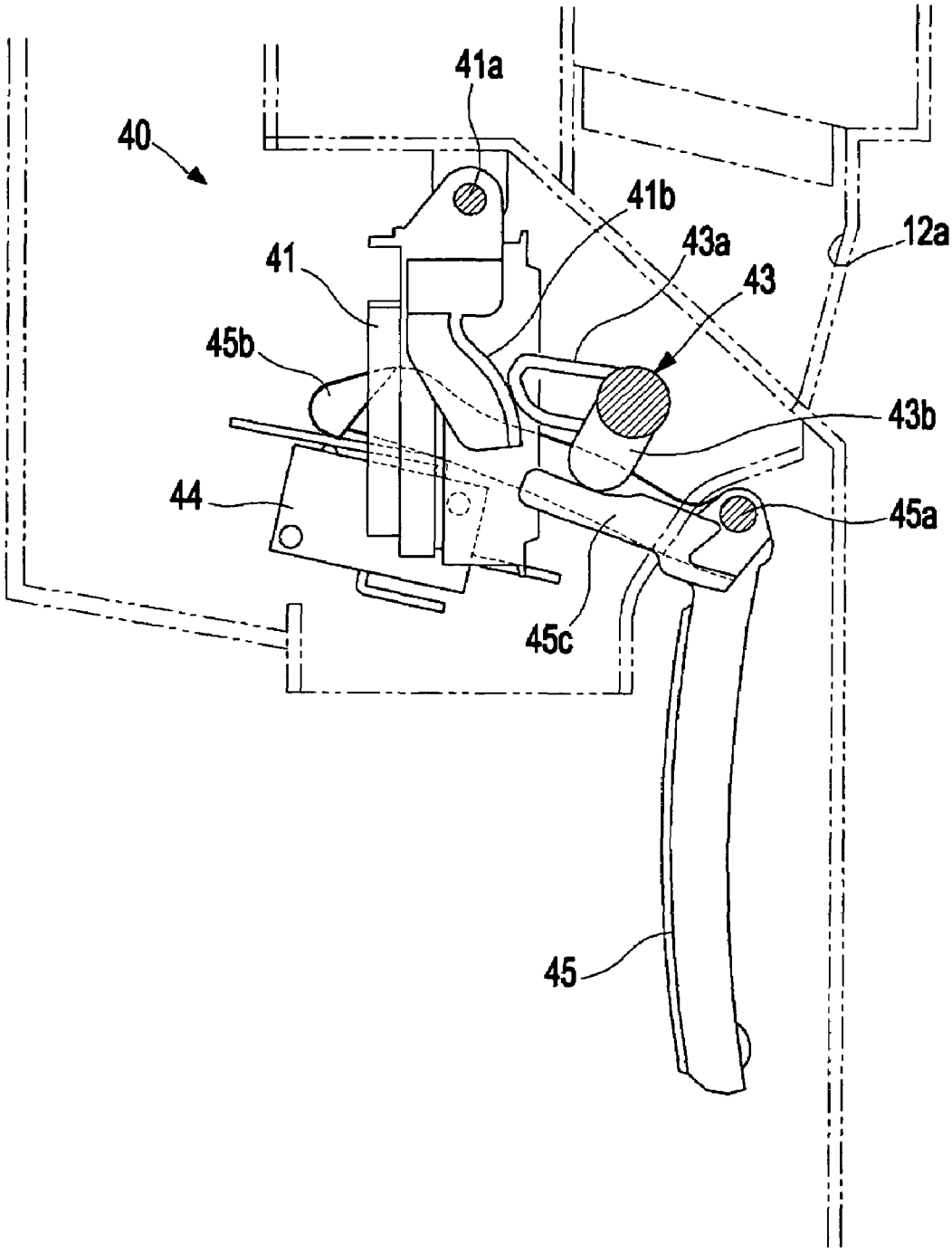
FIG. 5 is a side view illustrating the shaved ice discharger of FIG. 4 in a state of being pressed backward in accordance with the present invention.

In FIGS. 3 and 4, the shaved ice discharger 40 comprises a damper 41 hinged to one side of the shaved ice discharge port 12*a* to open/close the shaved ice discharge port 12*a*, and an opening/closing cam 43 rotated by a driving motor 42 which generates a rotational force such that the opening/closing cam 43 transmits the rotational force to the damper 41 to open the shaved ice discharge port 12*a*, a switch 44 to apply electric power to the driving motor 42 when depressed, and a discharge lever 45 hinged to the lower end of the shaved ice discharge port 12*a* and rotated upon application of an external force thereto to depress the switch 44. The damper 41 and the discharge lever 45 are hinged to one side of the shaved ice discharge port 12*a* and the lower end of the shaved ice discharge port 12*a* by means of a damper hinge shaft 41*a* and a discharge lever hinge shaft 45*a*, respectively, both of which include torsion springs S, so that the damper 41 is maintained in a state of closing the shaved ice discharge port 12*a* by virtue of an elastic force of the torsion spring S, and the lower end of the discharge lever 45 is maintained in a state of being elastically supported by virtue of an elastic force of the torsion spring S.

The discharge lever hinge shaft 45*a* comprises a pressing portion 45*b* extended upward and having a distal end protruded forward to depress the switch 44 with one end of the pressing part 45*b* such that, when the lower end of the discharge lever 45 is pressed backward by application of the external force, the pressing part 45*b* is rotated forward to depress the switch 44.

Accordingly, when the external force is applied to the discharge lever 45, which is elastically supported forward by the torsion spring S, the discharge lever 45 is pressed backward, whereby the pressing part 45*b* is moved forward, and depresses the switch 44. Then, the electric power is applied to the driving motor 42, and thus causes the opening/closing cam 43 to rotate, thereby allowing the damper 41 closing the shaved ice discharge port 12*a* to be rotated to open the shaved ice discharge port 12*a*, so that the shaved ice can be discharged to the outside through the shaved ice discharge port 12*a*.

Additionally, the shaved ice discharger 40 in accordance with an embodiment of the present invention is adapted to maintain an open state of the shaved ice discharge port 12*a* for a predetermined time according to an amount of the shaved ice selected by a user. The driving motor 42 comprises a step motor in order to maintain a rotational angle of the opening/closing cam 43 for a predetermined time, when the opening/closing cam 43 is rotated at a predetermined angle. Accordingly, the opening/closing cam 43 is rotated at the predetermined angle by the driving motor 42 to open the shaved ice discharge port 12*a*, which has been closed by the damper 41, and then the shaved ice discharge port 12*a* is maintained in the open state for a predetermined time set corresponding to the amount of the shaved ice selected by the user. Then, after lapse of the predetermined time, the opening/closing cam 43 is rotated to an original position thereof by the driving motor 42, so that the damper 41 returns to an original position thereof by an elastic force of the torsion spring S and closes the shaved ice discharge port 12*a*.

Moreover, the shaved ice discharger 40 is adapted to force the discharge lever 45 to be pressed backward when the damper 41 is rotated to open the shaved ice discharge port 12*a* by means of the opening/closing cam 43. Therefore, even when external force is not applied to the discharge lever 45, the discharge lever 45 can be maintained in the state of being pressed backward, thereby preventing the container C, which contains the shaved ice discharged through the shaved ice discharge port 12*a*, from moving in front of the refrigerator by virtue of the elastic force of the torsion spring S, which elastically supports the discharge lever 45.

The opening/closing cam 43 comprises a first cam 43*a* to transmit the rotational force to the damper 41, to allow the damper 41 to open the shaved ice discharge port 12*a*, and a second cam 43*b* protruded at predetermined angle thereon to transmit the rotational force to the discharge lever 45 so as to force the discharge lever 45 to be pressed backward. Moreover, the damper 41 comprises a first cam contact portion 41*b* protruded at one side thereof to contact the first cam 43*a* and to receive the force transmitted from the first cam 43*a* upon rotation of the first cam 43*a*, and the discharge lever 45 comprises a second cam contact portion 45*c* integrally extended from the discharge lever hinge shaft 45*a* to contact the second cam 43*b* and receive the rotational force transmitted from the second cam 43*b* upon rotation of the second cam 43*b*. Accordingly, when the opening/closing cam 43 is rotated by the driving motor 42, the first cam 43*a* of the opening/closing cam 43 rotates, and then transmits the rotational force to the first cam contact portion 41*b*, thereby hinging the damper 41 to open the shaved ice discharge port 12*a*, and the second cam 43*b* of the opening/closing cam 43 also rotates, and then transmits the force to the second cam contact portion 45*c*, thereby hinging the discharge lever 45 to force the lower end of the discharge lever 45 to be pressed backward.

Since the refrigerator according to the present invention is provided with the shaved ice discharger to maintain the open state of the shaved ice discharge port for the predetermined time, it is not necessary to continuously apply the external force to the lever, thereby improving convenience in use of the shaved-ice maker.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A refrigerator comprising:

a body having a freezing compartment defined therein;

a freezing compartment door to open and close the freezing compartment;

an ice tray to freeze water therein, thus forming ice cubes;

an ice cube container disposed below the ice tray to contain the ice cubes;

a shaved-ice maker positioned in the freezing compartment to produce shaved ice using the ice cubes supplied from the ice cube container;

a shaved ice discharge port to discharge the shaved ice produced by the shaved-ice maker to an outside of the refrigerator through the freezing compartment door; and a shaved ice discharger to open the shaved ice discharge port for a predetermined time, wherein the shaved ice discharger comprises a damper hinged to one side of the shaved ice discharge port to open and close the shaved ice discharge port while hinging, and an opening/closing cam to transmit a rotational force to the damper according to a rotational angle of the opening/closing cam, thereby operating the damper to open the shaved ice discharge port.

2. The refrigerator according to claim 1, wherein the opening/closing cam rotates by a driving motor which generates a rotational force, wherein the driving motor comprises a step motor to maintain the rotational angle of the opening/closing cam for the predetermined time.

3. The refrigerator according to claim 1, wherein the damper comprises a first cam contact portion at one side thereof, to contact the opening/closing cam, and to receive the rotational force transmitted from the opening/closing cam, wherein the opening/closing cam comprises a first cam protruded thereon, to contact and press the first cam contact portion while rotating.

4. The refrigerator according to claim 3, wherein the freezing compartment door comprises a switch to apply electric power to the driving motor when depressed, and a discharge lever hinged to a lower end of the shaved ice discharge port, and hingably moved by application of an external force applied thereto, to depress the switch.

5. The refrigerator according to claim 4, wherein the discharge lever comprises a second cam contact portion to allow the discharge lever to receive the rotational force from the opening/closing cam, thereby causing a lower end of the discharge lever to be pressed backward, and a second cam to contact and press the second cam contact portion while rotating.

6. A refrigerator comprising:

a body having a freezing compartment defined therein;

a freezing compartment door to open and close the freezing compartment;

a shaved-ice maker positioned in the freezing compartment to produce shaved ice;

a shaved ice discharge port to discharge the shaved ice produced by the shaved-ice maker to an outside of the refrigerator through the freezing compartment door;

a damper hinged to one side of the shaved ice discharge port to open and close the shaved ice discharge port;

a discharge lever hinged to a lower end of the shaved ice discharge port such that a lower end of the discharge lever is pressed backward to operate the damper to open the shaved ice discharge port; and an opening/closing cam to operate the damper to open the shaved ice discharge port while allowing the discharge lever to be pressed backward.

7. The refrigerator according to claim 6, wherein the opening/closing cam comprises:

a first cam to transmit the force to the damper while rotating to open the shaved ice discharge port; and a second cam to transmit the rotational force to the discharge lever, and to hinge the discharge lever backward, causing the lower end of the discharge lever to be pressed backward.

8. The refrigerator according to claim 6, wherein the opening/closing cam rotates by a driving motor which generates the rotational force, wherein the driving motor comprises a step motor to maintain a rotational angle of the opening/closing cam for a predetermined time.

9. The refrigerator of claim 8, wherein when an external force is not applied to the discharge lever, the discharge lever remains pressed in a backward direction for the predetermined period of time.

10. A refrigerator having a shaved-ice maker, the refrigerator comprising:

a shaved-iced discharge port to discharge shaved ice produced by the shaved-ice maker to an outside of the refrigerator; and a shaved-ice discharger to open the shaved ice discharge port for a predetermine period of time corresponding to an amount of shaved ice selected by a user.

11. The refrigerator of claim 10, further comprising:

a damper hinged to a side of the shaved ice discharge port to open and close the shaved ice discharge port; and a cam to transmit a rotational force to the damper according to a rotational angle of the cam, to thereby open the shaved ice discharge port.

* * * * *